US008376485B2

(12) United States Patent
Fujinami

(10) Patent No.: US 8,376,485 B2
(45) Date of Patent: Feb. 19, 2013

(54) INKJET RECORDING APPARATUS

(75) Inventor: Yasuyuki Fujinami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 13/005,782

(22) Filed: Jan. 13, 2011

(65) Prior Publication Data

US 2011/0181660 A1 Jul. 28, 2011

(30) Foreign Application Priority Data

Jan. 27, 2010 (JP) ..... 2010-015334

(51) Int. Cl.
*B41J 2/165* (2006.01)

(52) U.S. Cl. ..... 347/8

(58) Field of Classification Search ..... None
See application file for complete search history.

(56) References Cited

FOREIGN PATENT DOCUMENTS

JP 2007-136728 A 6/2007

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

A carriage with a recording head mounted therein is movably supported by a first guide member extending in a direction intersecting with a recording medium transport direction "a". The first guide member elastically deforms accompanying movements of the carriage and is arranged deviated from a gravity center of the carriage in the transport direction "a". An area of a second guide member that is in contact with the carriage curves in a direction containing a component of a direction parallel to the recording medium transport direction "a" in order to guide rotation of the carriage owing to the carriage's own weight when the carriage moves along the first guide member.

6 Claims, 5 Drawing Sheets

INKJET RECORDING APPARATUS

BACKGROUND OF THE INVENTION

1. Field of the Invention

The present invention relates to an inkjet recording apparatus.

2. Description of the Related Art

In an inkjet recording apparatus, a recording head has a certain distance to a recording medium, and an image is recorded onto the recording medium as a result of an ink discharged from the recording head flying through a space between the recording head and the recording medium and reaching the recording medium. Accordingly, when there is variation in the ink flight time and/or discharge vector, the ink landing positions on the recording medium become different from one another, causing image deterioration. The recording head is mounted in a carriage, which reciprocates in a direction intersecting with a transport direction of the recording medium, and thus, in order to provide favorable image recording, it is important to maintain the parallelism of reciprocation of the carriage and the flatness of the recording medium itself.

In order to maintain the parallelism of reciprocation of the carriage, that is, for a guide member for making the carriage run in parallel to a recording surface of the recording medium, a carriage shaft and a guide shaft are used. A carriage shaft movably supporting the carriage is a linear member. Since opposite ends of the carriage shaft are secured to the chassis, the carriage shaft slightly elastically deforms owing to its own weight and the weight of the carriage when the carriage moves along the carriage shaft. Accordingly, the distance between the recording head and the recording surface of the recording medium varies according to the position of the carriage when the carriage moves. As a result, variation occurs in the ink flight time, causing image deterioration.

In order to deal with the image deterioration resulting from variation in ink flight time, Japanese Patent Application Laid-Open No. 2007-136728 discloses a method in which ink discharge timing is changed according to the elastic deformation of a carriage shaft, and the moving direction and position of a carriage, thereby making an ink land at a target position.

However, the aforementioned method of changing the ink discharge timing is a method used for correcting deviation of an ink landing position from a target position on a recording medium in the carriage movement direction. Accordingly, in the aforementioned method, no consideration is given for the case where deviation of an ink landing position from a target position occurs in the recording medium transport direction, which intersects with the carriage movement direction.

SUMMARY OF THE INVENTION

An object of the present invention is to provide an inkjet recording apparatus enabling reduction of deviation of an ink landing position from a target position occurring in a recording medium transport direction owing to elastic deformation of a carriage shaft.

In order to attain the above-mentioned object, there is provided an apparatus comprising a carriage configured to hold a recording head that discharges an ink so as to face a recording medium transported in a first direction, and to reciprocate along a second direction intersecting with the first direction; a first guide member with opposite ends thereof secured, wherein the reciprocation of the carriage is guided along the first guide member while the carriage is supported by the first guide member, and the carriage is supported in such a manner that the carriage can rotate with reference to the first guide member, and wherein, viewed from the second direction, the first guide member is arranged at a position deviating from a position of a gravity center of the carriage supporting the recording head in the first direction, and the first guide member deforms in a direction containing a gravity direction and the first direction, upon receipt of a load from the carriage supported by the first guide member; and a second guide member configured to guide the carriage while being in contact with a part of the carriage when the carriage reciprocates, wherein when the second guide member comes into contact with the part of the carriage, the rotation of the carriage with reference to the first guide member is restricted, and an area of the second guide member that is in contact with the part of the carriage has a shape curved in a direction containing the first direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
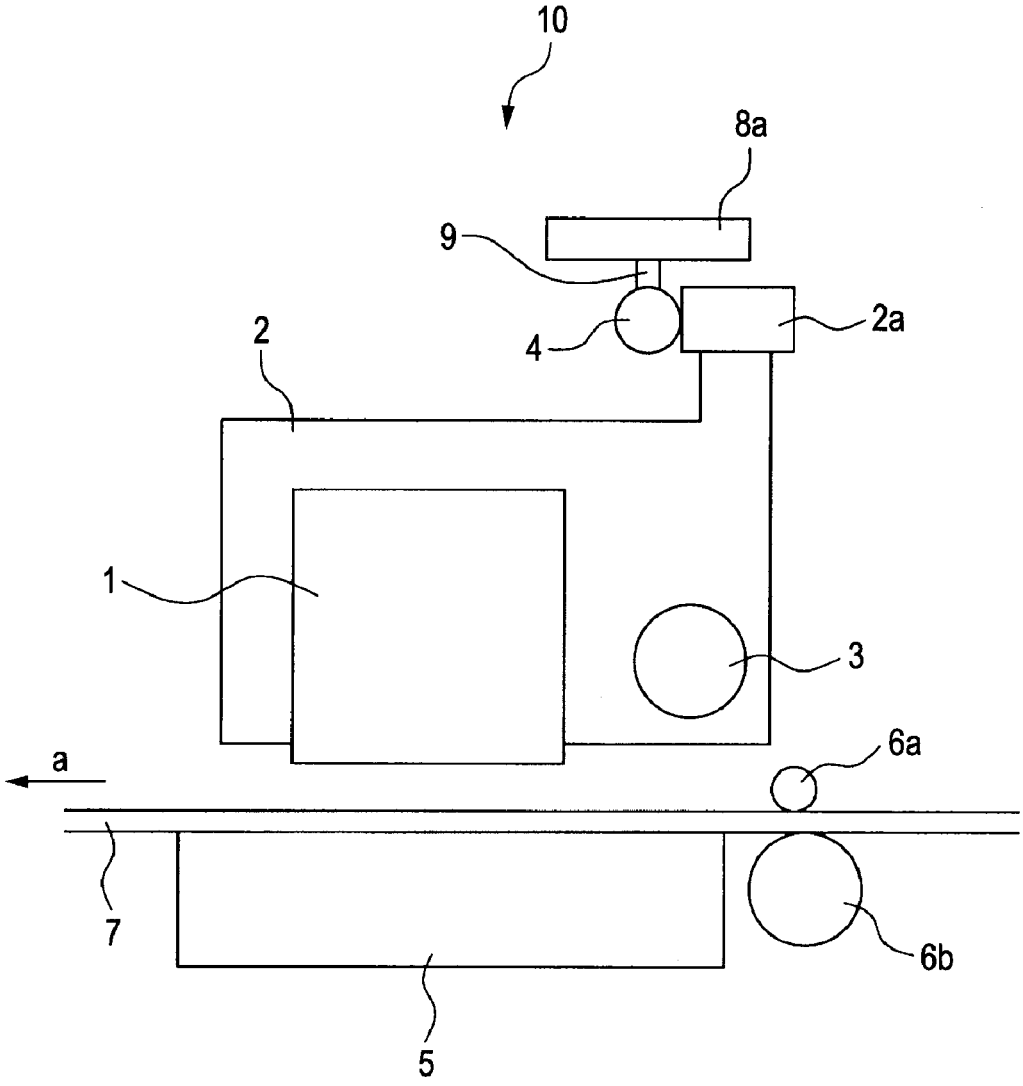
FIG. 1 is a schematic cross-sectional view of an inkjet recording apparatus according to the present invention.

FIG. 1 is a schematic cross-sectional view of an inkjet recording apparatus according to the present embodiment, which illustrates a cross section along a recording medium transport direction.

An inkjet recording apparatus 10 includes a recording head 1, a carriage 2 with the recording head 1 mounted therein, and a carriage shaft 3 (first guide member) and a guide shaft 4 (second guide member), each extending in a direction intersecting with a transport direction of "a" recording medium 7. The inkjet recording apparatus 10 also includes a platen 5 arranged at a position facing the recording head 1, the platen 5 supporting the recording medium 7, and a pair of transport rollers 6*a* and 6*b*, which is a transport mechanism that transports the recording medium 7 while making the recording medium 7 be in contact with the platen 5 to form a recording surface. By means of the transport mechanism, the recording medium 7 is transported in a first direction.

The recording head 1 includes a plurality of nozzle rows, each including a plurality of nozzles for discharging ink, as described later. The nozzle rows are arranged in parallel in a direction orthogonal to a nozzle row direction. The recording head 1 is mounted in the carriage 2 in such a manner that the recording head 1 can move in the direction in which the nozzle rows are arranged in parallel. The carriage 2 is guided for reciprocation movements in a second direction intersecting with, in the present embodiment, substantially orthogonal to, the transport direction "a" of the recording medium 7 (i.e., a direction orthogonal to a plane of a paper on which the FIG.

1 is drawn, by the carriage shaft 3. The guide shaft 4 is provided as a guide for keeping a posture of the carriage 2 when the carriage 2 moves.

The carriage shaft 3 is a shaft-like member having a circular cross-sectional shape and extending in the direction intersecting with the transport direction "a" of the recording medium 7. The carriage shaft 3 movably supports the carriage 2 along the shaft direction of the carriage shaft 3 while supporting the carriage 2 in such a manner that the carriage 2 can rotate with reference to the carriage shaft 3. Opposite ends of the carriage shaft 3 are secured to a chassis 8*b* (which may be a frame that can be regarded as being equivalent to a chassis) of the apparatus. When the carriage 2 moves along the shaft direction, as described later, the carriage shaft 3 elastically deforms mainly owing to a load from the carriage 2. Meanwhile, the guide shaft 4 serves to guide the carriage 2, which moves along the carriage shaft 3, while being in contact with the carriage 2 via a rotator 2*a* attached at an upper portion of the carriage 2. The guide shaft 4 is secured to the chassis 8*a* via a plurality of securing members 9, and accordingly, has a sufficiently-high bending stiffness and causes only a small amount of elastic deformation that can be ignored. When the carriage 2 moves along the shaft direction of the carriage shaft 3, the guide shaft 4 has almost no deformation compared to deformation of the carriage shaft 3. In the present embodiment, the guide shaft 4 is a shaft member having a circular cross-sectional shape as is the carriage shaft 3.

Next, the principle of the carriage shaft 3 elastically deforming upon receipt of a load from the carriage 2 when the carriage 2 moves along the carriage shaft 3 in the inkjet recording apparatus 10 according to the present embodiment will be described with reference to FIG. 2.

Figure 2:
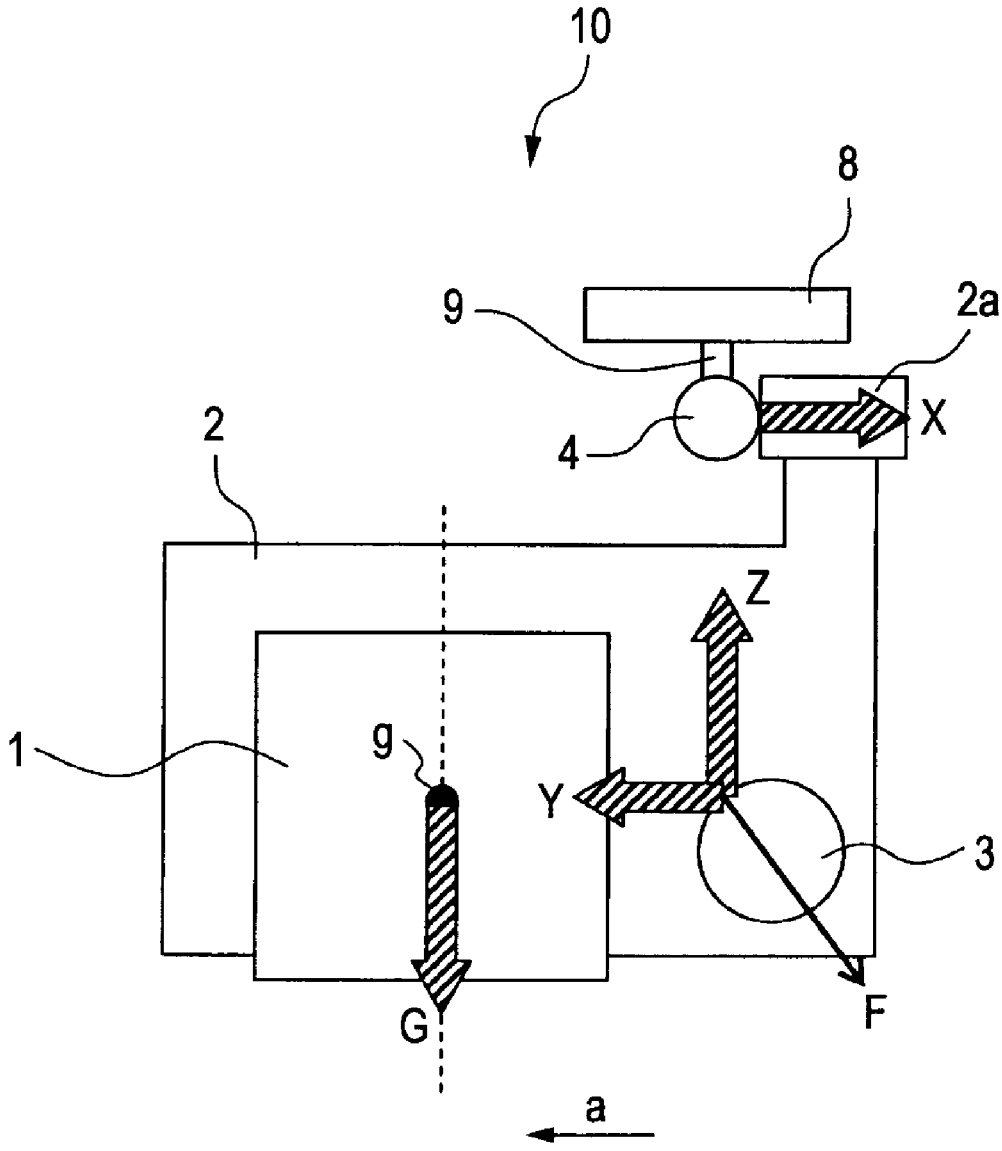
FIG. 2 is a diagram illustrating loads exerted on a carriage.

As is FIG. 1, FIG. 2 is a cross-section diagram schematically illustrating the inkjet recording apparatus according to the present embodiment. FIG. 2 illustrates only a part related to the carriage 2 in order to describe loads exerted on the carriage 2, in which loads exerted on the carriage 2 and the carriage shaft 3 are indicated with several arrows.

Forces exerted on the carriage 2 in a gravity direction (third direction) include a gravity force exerted downward (see arrow G in the Figure) and an upward force from the carriage shaft 3 (see arrow Z in the Figure). In the present embodiment, as can be seen from FIGS. 1 and 2, the carriage shaft 3 is arranged away from a vertical line (see the dotted line in FIG. 2) passing through a gravity center of the carriage 2, upstream in the recording medium transport direction "a". Accordingly, the carriage 2 is urged to rotate counterclockwise in the Figure with reference to the carriage shaft 3 by its own weight (see arrow G in the Figure); however, because of the carriage 2 being in contact with the guide shaft 4, such rotation is restricted. Here, the guide shaft 4 is positioned above a horizontal line passing through a shaft center of the carriage shaft 3 in the gravity direction. Accordingly, a force including a component of a direction (the first direction) opposite to the recording medium transporting direction "a", which restricts such rotation, is exerted on the carriage 2 by the guide shaft 4 (see arrow X in the Figure). Meanwhile, a load in a direction opposite to the direction of such force is exerted on the carriage 2 by the carriage shaft 3 (see arrow Y in the Figure).

A load that is a force (see arrow F in the Figure) counteracting loads exerted on the carriage 2 (arrows Z and Y in the Figure) is exerted on the carriage shaft 3, resulting in the carriage shaft 3 elastically deforming in the direction of arrow F. Arrow F contains a gravity direction component and a horizontal direction component. As described above, since the opposite ends of the carriage shaft 3 are secured to the chassis, the amount of elastic deformation of the carriage shaft 3 increases as the carriage 2 moves closer to a center portion of the carriage shaft 3 and reaches a maximum when the carriage 2 is positioned at the center of the carriage shaft 3. Meanwhile, the guide shaft 4 receives a force counteracting the load indicated by arrow X from the carriage 2; however, as described above, the guide shaft 4 is secured to the chassis 8 via the plurality of securing members 9, and thus, has a sufficiently-high bending stiffness, and causes only a small amount of elastic deformation that can be ignored.

As described above, the carriage shaft 3 curves in a direction including a component of a downward direction in the gravity direction. Accordingly, when the carriage 2 moves, the space between the recording head 1 and the recording medium changes. In order to exclude the effect of such change, the present embodiment provides such a configuration that a fixed space is kept between the area of a carriage shaft supporting the carriage and the area of a platen that faces the area when the carriage moves along the carriage shaft. More specifically, the platen has a curved supporting surface (non-planar surface) according to deformation of the carriage shaft 3 in the gravity direction so as to suppress change of the space between the platen and the nozzle rows of the recording head 1 when the carriage moves along the first guide member. Consequently, the carriage 2 can move along the carriage shaft 3 in a state in which the space between the carriage 2 and the recording medium supported by the platen is kept substantially constant.

Next, with reference to FIGS. 3A and 3B, the principle of image deterioration being caused as a result of such deviation of an ink landing position from a target position that occurs in the transport direction "a" of the recording medium 7 due to elastic deformation of the carriage shaft 3 will be described.

Figure 3A:
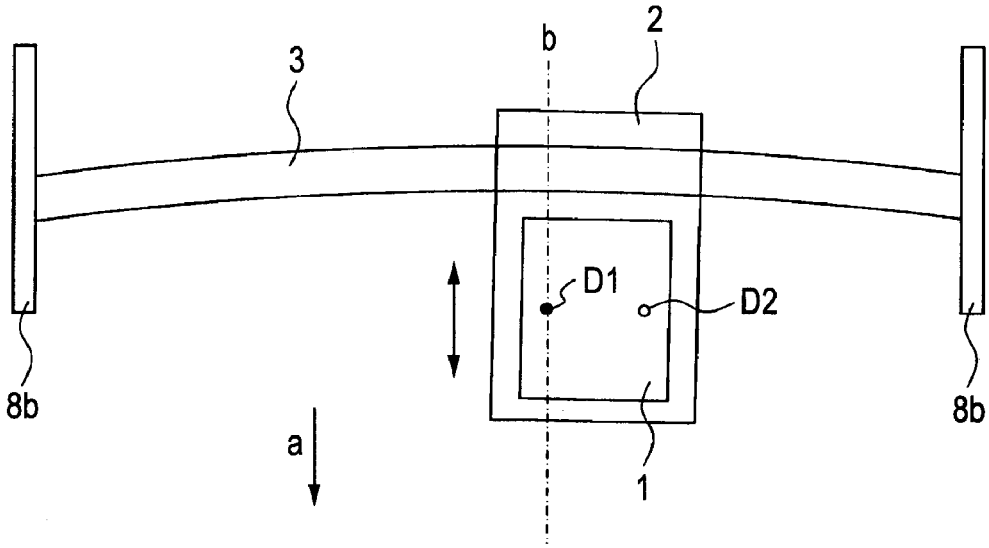
FIGS. 3A and 3B are diagrams illustrating elastic deformation of a carriage shaft accompanying a movement of a carriage.
Figure 3B:
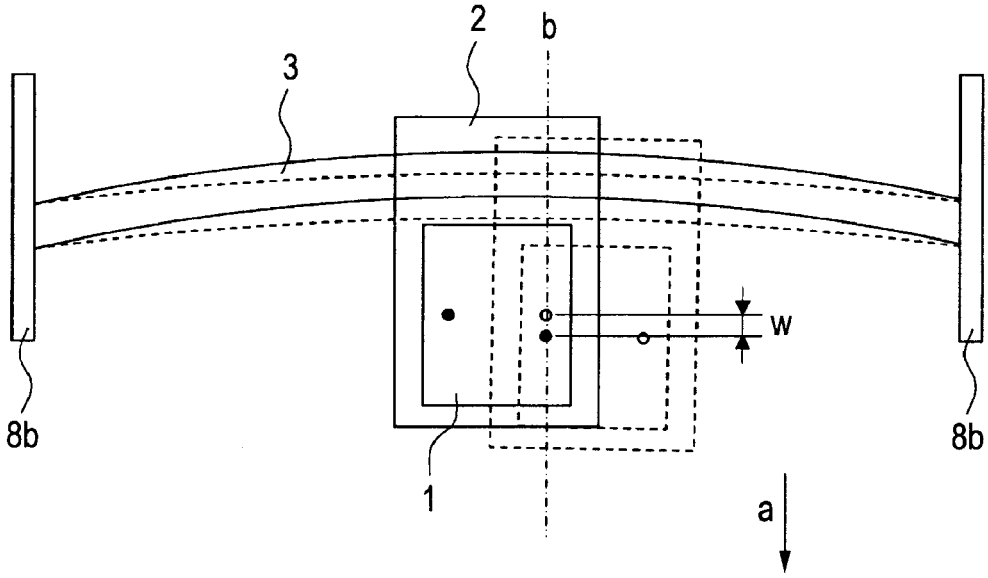

FIGS. 3A and 3B are schematic diagrams each illustrating the carriage 2 and the carriage shaft 3 with the opposite ends thereof secured to the chassis 8*b* on a plane parallel to the recording medium 7 in the inkjet recording apparatus 10 illustrated in FIG. 1. FIGS. 3A and 3B illustrate a state in which nozzles D1 and D2 provide discharge at a predetermined position b in a direction intersecting with the recording medium transport direction "a", that is, substantially a direction of carriage movement, respectively. While in the recording head 1, a plurality of nozzle rows, each including a plurality of nozzles for discharging ink, are arranged in parallel in a direction orthogonal to the nozzle row direction, the nozzles D1 and D2 are nozzles belonging to different nozzle rows but equal to each other in position in the nozzle row direction. The dotted lines in FIG. 3B indicate the carriage 2 and the carriage shaft 3 in FIG. 3A. Arrow "a" in the Figures indicates the recording medium transport direction.

As described above, the amount of elastic deformation of the carriage shaft 3 changes according to the position of the carriage 2. In other words, the amount of elastic deformation of the carriage shaft 3 increases so as to move the carriage 2 upstream in the transport direction "a", as a result of the carriage 2 moving by the space between the nozzles D1 and D2 in the shaft direction. Consequently, the nozzle D2 in the carriage 2 illustrated in FIG. 3B deviates upstream in the recording medium transport direction "a" from the nozzle D1 in the carriage illustrated in FIG. 3A by a distance W at the predetermined position "b". Accordingly, where inks discharged from the nozzles fly perpendicularly to the recording medium (which is parallel to a plane of a paper on which the Figure is drawn), the nozzle position deviation causes deviation of an ink landing position on the recording medium, and consequently causes image deterioration.

In the present embodiment, in order to reduce ink landing position deviation resulting from such nozzle position deviation, the angle of the carriage 2 relative to the recording medium 7 when the carriage 2 moves changes according to the position of the carriage 2. In other words, in the present embodiment, the guide shaft 4 that guides rotation of the carriage 2 when the carriage 2 moves is formed so as to have a large curve in a direction containing a component of an upstream direction in the transport direction. The principle of ink landing position deviation being reduced by the guide shaft 4 formed as described above will be described with reference to FIGS. 4A and 4B, and the states of the guide shaft 4 are illustrated in FIGS. 5A and 5B.

Figure 4A:
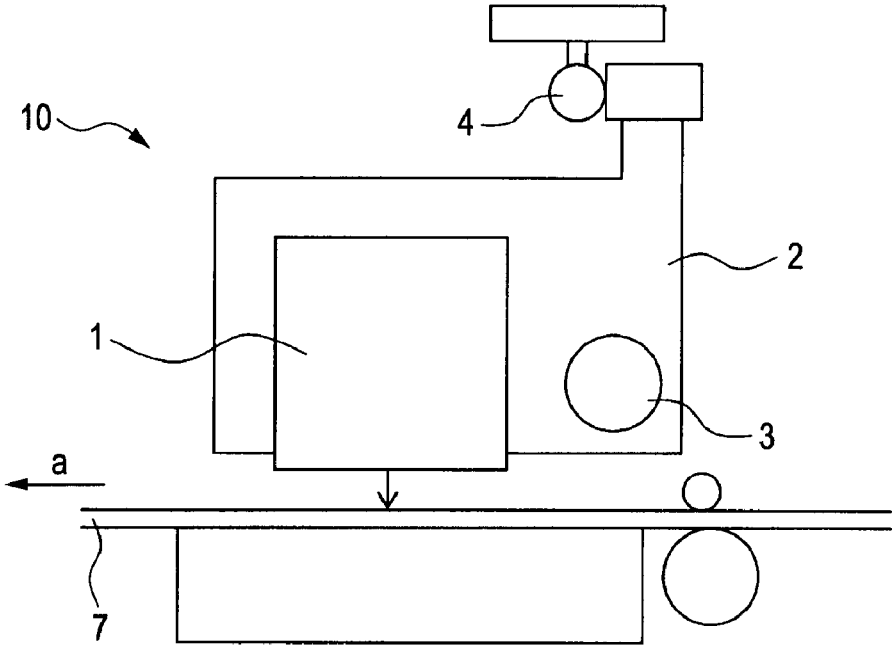
FIGS. 4A and 4B are diagrams illustrating rotation of a carriage by a guide shaft.
Figure 4B:
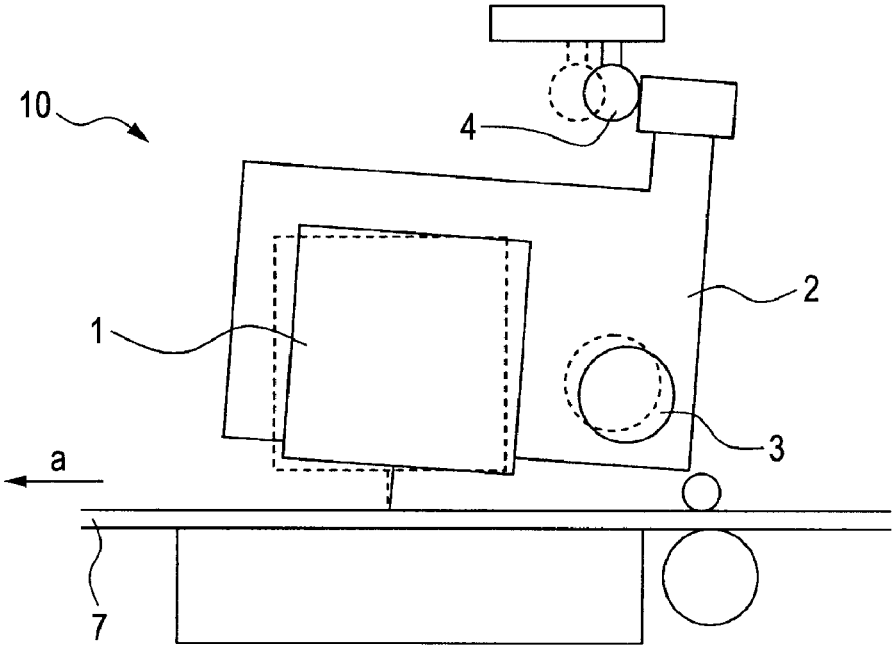
Figure 5A:
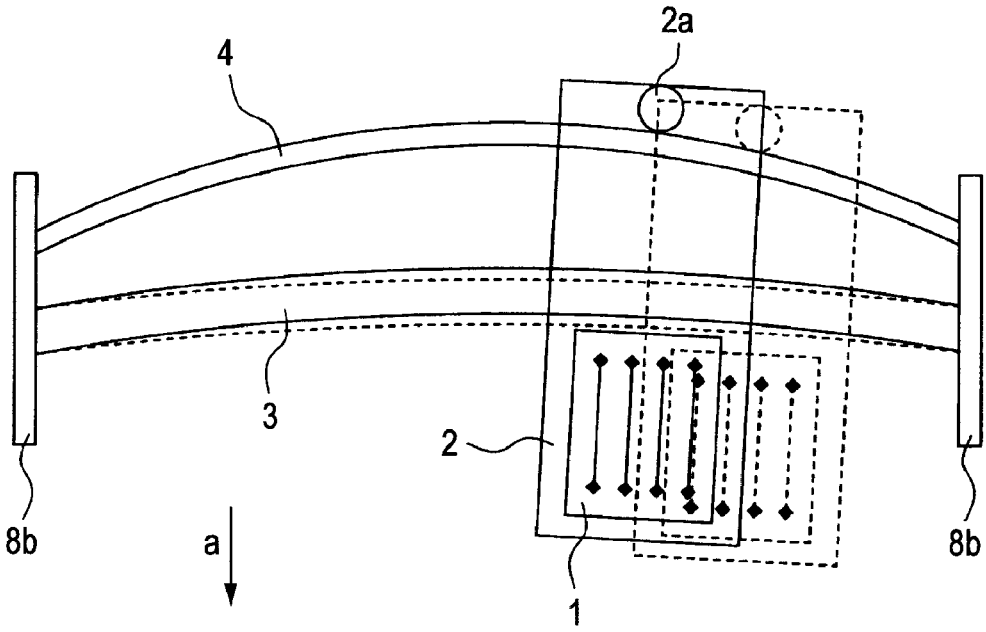
FIGS. 5A and 5B are partial schematic views of an inkjet recording apparatus according to the present invention.
Figure 5B:
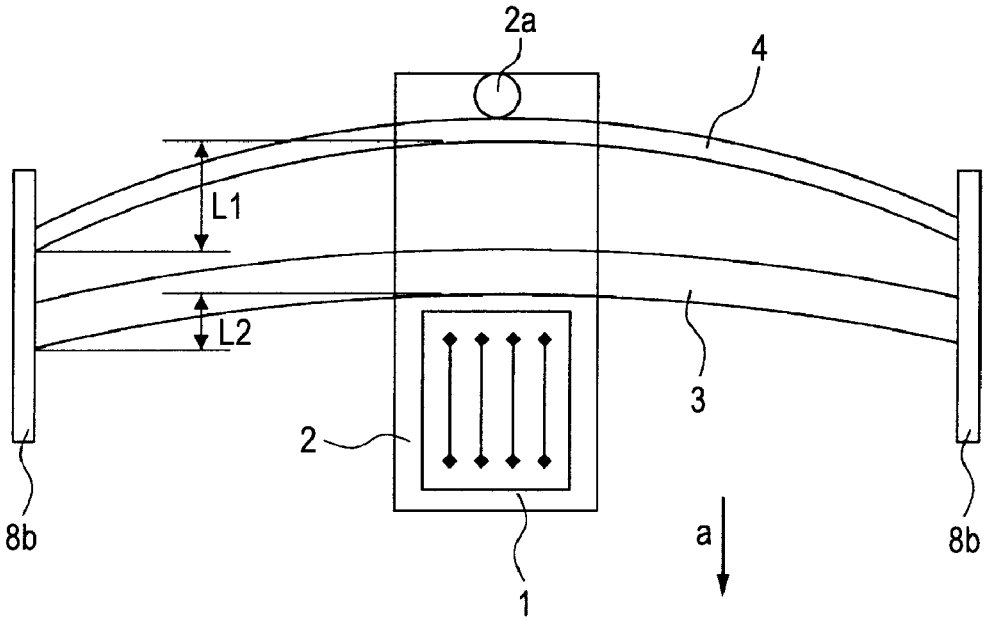

FIGS. 4A and 4B are schematic cross-sectional diagrams of the inkjet recording apparatus according to the present embodiment as is FIG. 1, which each illustrate a cross section along the recording medium transport direction. FIG. 4A indicates a state in which a frontmost nozzle (for example, the nozzle D1 in FIGS. 3A and 3B) provides discharge at a predetermined position. The arrow connecting the recording head 1 and the recording medium 7 indicates a trajectory of an ink discharged from the frontmost nozzle landing on the recording medium 7. Meanwhile, FIG. 4B indicates a state in which a following nozzle (for example, the nozzle D2 in FIG. 3A and 3B) whose position in the nozzle row direction is equal to that of the frontmost nozzle provides discharge at the predetermined position. The dotted lines illustrated in FIG. 4B indicate the recording head 1, the carriage shaft 3 and the guide shaft 4 illustrated in FIG. 4A. FIGS. 5A and 5B are diagrams each schematically illustrating the carriage 2, the carriage shaft 3 and the guide shaft 4 in the inkjet recording apparatus 10 according to the present embodiment on a plane parallel to the recording medium 7. FIG. 5A is a diagram corresponding to the inkjet recording apparatus 10 illustrated in FIG. 4B, and FIG. 5B is a diagram illustrating the inkjet recording apparatus 10 when the carriage 2 is located at the center of the carriage shaft 3.

When the carriage 2 moves from the state illustrated in FIG. 4A to the state illustrated in FIG. 4B, a part of the carriage shaft 3 that supports the carriage 2 deforms upstream in the transport direction "a" of the recording medium 7 in such a manner that the part comes close to the recording medium 7 as described with reference to FIG. 2 (see FIG. 4B). The guide shaft 4 has a large curve so that the amount of displacement of the point of contact between the guide shaft 4 and the carriage 2 is larger than the amount of deformation of the carriage shaft 3 in such state (see FIGS. 5A and 5B). Accordingly, as illustrated in FIG. 4B, the carriage 2 rotates clockwise in the Figure with reference to the carriage shaft 3, entering a state in which the carriage 2 is inclined upstream in the transport direction "a" of the recording medium 7. Consequently, an ink discharged from the following nozzle at the predetermined position also flies not perpendicularly to the recording medium 7, but with an inclination, resulting in the ink landing on the recording medium 7 at a position downstream in the transport direction "a" of the nozzle position in the recording head 1. In other words, the curve of the guide shaft 4 reduces deviation of a position on the recording medium at which an ink discharged from a nozzle lands, which is caused by the effect of elastic deformation of the carriage shaft 3. As illustrated in FIG. 3B, even if there is a deviation in position between the two nozzles, positions on which inks discharged from those different positions land come close to each other along the recording medium transport direction, enabling reduction of image deterioration. The shape of the guide shaft 4 can be determined so that the displacements in the transport direction of the nozzle positions due to elastic deformation of the carriage shaft 3 and the displacements of the ink landing positions due to change of the inclination of the carriage 2 relative to the recording medium 7 cancel each other out. As illustrated in FIG. 5B, in the present embodiment, a largest amount L1 of displacement in the transport direction "a" of the guide shaft 4 is larger than a largest amount L2 of elastic deformation of the carriage shaft 3 when the carriage 2 is located at the center of the carriage shaft 3.

As described above, deviation of a position on the recording medium at which an ink discharged from a nozzle lands, which is caused by the effect of elastic deformation of the carriage shaft 3 when the carriage 2 moves along the carriage shaft 3, is reduced. Furthermore, relative deviation of positions on the recording medium at which inks discharged from a plurality of nozzles that are equal to each other in position in the nozzle row direction land can be reduced (ideally, the ink landing positions are made to correspond to each other). Consequently, image deterioration resulting from deviation of ink landing positions from target positions, which is caused by elastic deformation of the carriage shaft in the recording medium transport direction, can be reduced.

Although in the present embodiment, the guide shaft 4 is a shaft member having a curved arc shape, any member that can change the inclination of the carriage shaft according to the position of the carriage may be employed, and thus, any member whose area in contact with the carriage is curved in a direction containing a component of the upstream direction in the transport direction may be employed. For example, a plate member having a contact surface in a semicircular or crescentic arc shape can be used instead of the guide shaft 4.

It should be noted that the effects provided by the present invention do not depend on the recording medium transport direction. In other words, although in the present specification, as illustrated in FIG. 1, description has been given in terms of the case where the carriage shaft is arranged away from the vertical line, which includes the gravity center of the carriage, upstream in the recording medium transport direction, as an example, the present invention is not limited to this example. In other words, the carriage shaft may be arranged out of the vertical line downstream in the recording medium transport direction, and in such case, the guide shaft may be formed so as to curve downstream in the transport direction. In other words, for example, in the configuration illustrated in FIG. 1, the recording medium transport direction may be either leftward or rightward in the Figure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-015334, filed Jan. 27, 2010, which is hereby incorporated by reference herein in its entirety.

What is claimed is:

1. An apparatus comprising:

a carriage configured to hold a recording head that discharges an ink so as to face a recording medium transported in a first direction, and to reciprocate along a second direction intersecting with the first direction;

a first guide member with opposite ends thereof secured, wherein the reciprocation of the carriage is guided along the first guide member while the carriage is supported by the first guide member, and the carriage is supported in such a manner that the carriage can rotate with reference to the first guide member, and wherein, viewed from the second direction, the first guide member is arranged at a position deviating from a position of a gravity center of the carriage supporting the recording head in the first direction, and the first guide member deforms in a direction containing a gravity direction and the first direction, upon receipt of a load from the carriage supported by the first guide member; and a second guide member configured to guide the carriage while being in contact with a part of the carriage when the carriage reciprocates, wherein when the second guide member contacts with the part of the carriage, the rotation of the carriage with reference to the first guide member is restricted, and an area of the second guide member that is in contact with the part of the carriage has a shape curved in a direction containing the first direction.

2. The apparatus according to claim 1, wherein the part of the carriage that is in contact with the second guide member is arranged above a shaft center of the first guide member in the gravity direction, viewed from the second direction.

3. The apparatus according to claim 1, wherein each of the first guide member and the second guide member includes a shaft having a circular cross section.

4. The apparatus according to claim 1, further comprising a platen provided so as to face the recording head, the platen supporting the recording medium transported, the platen including a supporting surface that curves according to the deformation in the gravity direction of the first guide member.

5. The apparatus according to claim 1, wherein the area of the second guide member that is in contact with the part of the carriage has an arc shape in order to reduce deviation of a position on the recording medium at which an ink discharged from the recording head lands, the deviation occurring due to the deformation of the first guide member.

6. The apparatus according to claim 1, wherein the recording head includes a plurality of nozzle rows arranged in the second direction, and the area of the second guide member that is in contact with the part of the carriage has an arc shape in order to reduce relative deviation of positions at which inks discharged from nozzles land, the nozzles being equal to each other in position in the first direction in the plurality of nozzle rows.

* * * * *